US005149152A

United States Patent [19]

Lanius

[11] Patent Number: 5,149,152

[45] Date of Patent: Sep. 22, 1992

[54] LOCKABLE LATCH ASSEMBLY WITH FLEXIBLE BAND LOCKING MEMBER SURROUNDING A CAM SURFACE

[75] Inventor: Charles A. Lanius, Prairie du Sac, Wis.

[73] Assignee: Flambeau Products Corporation, Middlefield, Ohio

[21] Appl. No.: 831,874

[22] Filed: Feb. 6, 1992

[51] Int. Cl.[5] ..... E05C 9/04

[52] U.S. Cl. ..... 292/37; 292/247; 292/140; 292/DIG. 38

[58] Field of Search ..... 312/DIG. 33; 220/324; 292/32, 33, 34, 37, DIG. 38, 247, 248, 106, 107, 207, 208, 209, 140

[56] References Cited

U.S. PATENT DOCUMENTS

| | | | |
|---|---|---|---|
| 203,232 | 4/1878 | Worthington . | |
| 1,019,678 | 5/1912 | Mason . | |
| 1,704,316 | 3/1929 | Geschickter . | |
| 1,901,613 | 3/1933 | Smith . | |
| 1,941,225 | 12/1933 | Radke et al. | 292/37 |
| 2,277,231 | 3/1942 | Ilieff . | |
| 2,389,315 | 11/1945 | Kerr | 292/38 |
| 2,819,601 | 1/1958 | Atkinson | 292/247 |
| 2,905,943 | 9/1959 | Tocchetto | 292/37 |
| 3,711,139 | 1/1973 | Polk, Jr. | 292/37 |
| 3,909,888 | 10/1975 | Funston et al. | 292/DIG. 38 |
| 4,074,549 | 2/1978 | Yee | 297/247 |
| 4,662,664 | 5/1987 | Wendt et al. | 292/19 |
| 4,781,407 | 11/1988 | Rauchhaus | 292/37 |
| 4,915,913 | 4/1990 | Williams | 292/247 |
| 4,971,371 | 11/1990 | Gunderson | 292/DIG. 38 |
| 4,971,372 | 11/1990 | Gunderson | 292/80 |

FOREIGN PATENT DOCUMENTS

| | | | |
|---|---|---|---|
| 1294001 | 4/1962 | France | 292/34 |
| 687348 | 3/1965 | Italy | 292/37 |
| 709399 | 6/1966 | Italy | 292/34 |
| 551451 | 2/1943 | United Kingdom | 292/247 |

*Primary Examiner*—Eric K. Nicholson
*Attorney, Agent, or Firm*—Michael, Best & Friedrich

[57] ABSTRACT

A lockable latch assembly including a base, a latch member pivotally supported on the base for movement between a latched position and an unlatched position, and a locking mechanism housed in the base. The locking mechanism comprises a driver member that is pivotable between a lock position and an unlock position, the driver member including an elliptical outer cam surface. The locking mechanism also comprises a locking member including a flexible band surrounding the cam surface and slidingly engaging the cam surface, the band being deformable to conform to the contour of the cam surface, and a pair of diametrically opposed locking bars extending radially outwardly from the band. Pivotal movement of the driver member actuates reciprocal movement of the locking bars between extended and retracted postions by deforming the band. When in the extended positions the locking bars are engagable with the latch member to restrict movement thereof from the latched position.

20 Claims, 3 Drawing Sheets

LOCKABLE LATCH ASSEMBLY WITH FLEXIBLE BAND LOCKING MEMBER SURROUNDING A CAM SURFACE

BACKGROUND OF THE INVENTION

1. Field of the Invention

The invention relates generally to latch arrangements, and more particularly to a latch mechanism which can be incorporated into a latch assembly to selectively lock the latch assembly in a latched position.

2. Reference to Prior Art

Fishing tackle boxes, tool boxes and the like typically include a hinged cover which can be secured in a closed position by one or more latch assemblies. Latch assemblies used in such applications are well known, each latch assembly including a lower latch component pivotally mounted on the box and an upper latch component pivotally mounted on the lower latch component. The upper latch component includes a catch which is engageable with a tongue on the cover of the box. To latch the cover of the box in the closed position, the catch on the upper latch component is positioned to capture the tongue on the cover, and the lower latch component is then pivoted downwardly. In some latch assembly arrangements, a padlock can be used to lock the latch assembly in the latched position. To unlatch the cover, the lower latch component is pivoted upwardly to disengage the catch from the tongue on the cover.

A latch mechanism employing spring biased retractable latch pins for snap-lock attachment to a structure is provided in U.S. Pat. No. 3,711,139 issued Jan. 16, 1973 to Polk, Jr. In this patent, the latch mechanism includes a housing with an annular slot and an inner wall defining an enclosed elliptical cavity. The enlarged inner heads of the latch pins extend through the slot and into the cavity and abut a normally round spring housed in the cavity to bias the latch pins outwardly. A wrench is used to rotate the housing so that the elliptical shape of the inner wall cams the heads of the latch pins inwardly against the force of the spring.

An elastic rhomboid body for a latch mechanism is illustrated in U.S. Pat. No. 4,781,407 issued Nov. 1, 1988 to Rauchhaus. In this patent, locking rods are attached to the outer surface of the rhomboid body and opposing push members are attached to the inner surface thereof. The locking rods are normally located in outward positions, but can be retracted by insertion of a square pin between the push members to distort the rhomboid body.

SUMMARY OF THE INVENTION

The present invention provides an improved latch mechanism for lock or latch applications in which it is desirable to selectively secure members from movement relative to one another. In one embodiment of the invention, the latch mechanism is incorporated into a latch assembly and provides a locking system for the latch assembly. More specifically, the latch or locking mechanism includes a pivotably supported, generally oblong driver member having an elongated and annular outer cam surface and a flexible band slidingly engaging the cam surface. The band includes oppositely disposed locking bars that are selectively retracted and extended in response to distortion of the band brought about by pivotal movement of the driver member to unlock and lock the latch assembly.

More particularly, the invention provides a latch assembly including a base adapted to be pivotally attached to a container, a latch member supported on the base for movement relative thereto between a latched position and an unlatched position, and a locking mechanism. The locking mechanism includes a driver member supported on the base for selective pivotal movement relative thereto between a lock position and an unlock position. The driver member includes an elongated, annular outer cam surface. The locking mechanism also includes a locking member having a flexible band surrounding the cam surface and slidingly engaging the cam surface. The band is deformable to conform to the contour of the cam surface. The locking member further includes a locking bar moveable with a portion of the band and extending radially outwardly from that band portion. The locking bar is reciprocally moveable relative to the base in response to deformation of the band between a retracted position when the driver member is moved to the unlock position and an extended position when the driver member is moved to the lock position. The locking bar is engageable with the latch member to restrict movement thereof relative to the base when the locking bar is in the extended position.

The invention also provides a latch assembly including a base, a latch member supported on the base for movement relative thereto between a latched and unlatched positions, and a driver member supported on the base for selective pivotal movement relative thereto about a pivot axis and between a lock and unlock positions. The driver member includes a longitudinal axis perpendicular to the pivot axis and an annular outer cam surface, the cam surface being elongated in the direction of the longitudinal axis and the cam surface being parallel to the pivot axis. The latch assembly also includes a locking member including a flexible band surrounding the cam surface, the band being deformable to conform to the contour of the cam surface. The locking member also includes a locking bar extending radially outwardly from and moveable with a portion of the band. The locking bar is moveable between a retracted position wherein the locking bar is disengaged from the latch member and an extended position wherein the locking bar is engageable with the latch member to prevent movement thereof from the latched position to the unlatched position. The band is deformable responsive to pivotal movement of the driver member to selectively reciprocate the locking bar between the retracted and extended positions.

The invention further provides a latch assembly for a storage box including a container portion and a cover portion hingedly mounted on the container portion and moveable between closed and opened positions relative to the container portion. The latch assembly includes a base adapted to be mounted on one of the cover portion and the container portion, and a latch member supported on the base for movement relative thereto between a latched position wherein the latch member is adapted to engage the other of the cover portion and the container portion to secure the cover portion in the closed position and an unlatched position wherein the latch member is disengaged from the other of the cover portion and the container portion so as to permit movement of the cover portion to the opened position. The latch assembly also includes a locking mechanism for selectively retaining the latch member in the latched position. The locking mechanism includes a driver member supported on the base for selective pivotal movement relative thereto between a lock and unlock positions, the driver member including an elongated annular outer cam surface. The locking mechanism also includes a locking member including a flexible band surrounding the cam surface and slidingly engaging the cam surface, the band being deformable to conform to the contour of the cam surface. The locking member also includes a locking bar extending radially outwardly from and moveable with a portion of the band. The locking bar is reciprocally moveable relative to the base between a retracted position when the driver member is moved to the unlock position and an extended position when the driver member is moved to the lock position. The locking bar is engagable with the latch member to restrict movement thereof relative to the base when the locking bar is in the extended position.

Other features and advantages of the invention will become apparent to those skilled in the art upon review of the following detailed description, claims and drawings.

Figure 1:
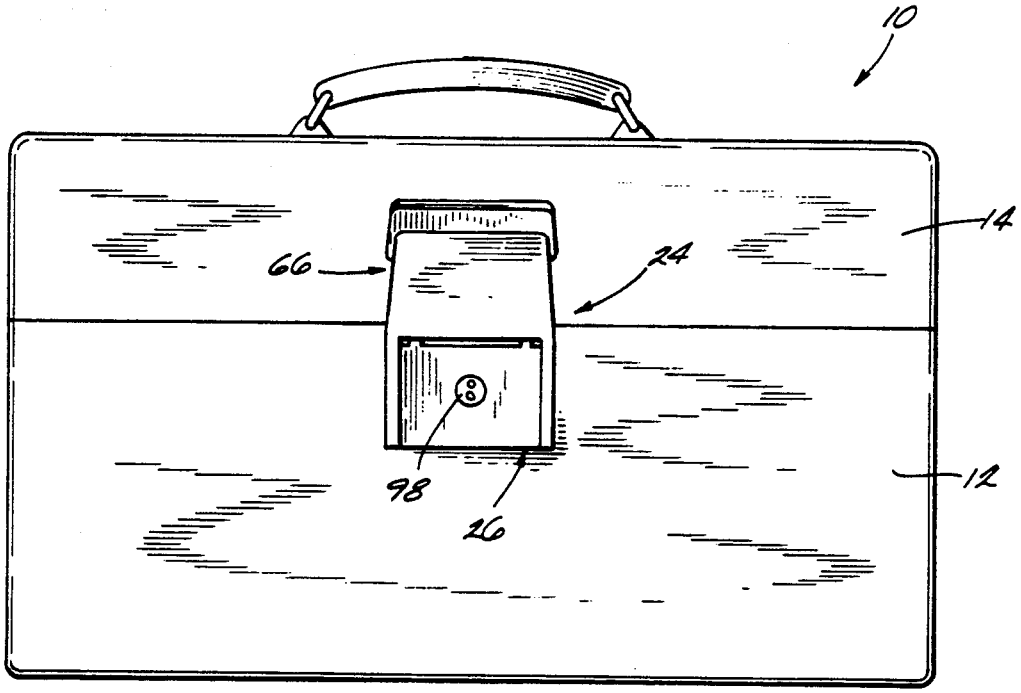
FIG. 1 is a front elevation view of a storage box employing a lockable latch assembly which is shown in a latched position to secure the cover of the storage box in a closed position.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

GENERAL DESCRIPTION

Illustrated in FIG. 1 is a storage container or box 10 for storing small items such as fishing tackle, hardware supplies, hobby supplies and the like. The storage box 10 includes a bottom or container portion 12 and a top portion or cover 14 hingedly mounted on the container portion 12.

To accommodate a mechanism for latching the cover 14 in a closed position, the storage box 10 is provided with latch assembly support means. While various latch assembly support means can be used, in the illustrated arrangement (see FIGS. 7–9) the latch assembly support means includes a pair of spaced apart, integral projections 16 for supporting a pivot pin 18 on the container portion 12. The latch assembly support means also includes a tongue 20 on the cover 14 to facilitate securement of the cover 14 in a closed position, as further explained below.

To selectively latch the cover 14 shut, the storage box 10 also includes a latch assembly 24 which embodies various features of the invention. As shown in FIGS. 2–6, the latch assembly 24 comprises a housing or base 26 including a lower latch component 28. As shown best in FIG. 6, the lower latch component 28 includes a pair of spaced apart, oppositely disposed end sections 30 each including a lower mounting hole 32, a more centrally located rectangular guide slot 34, and an upper inwardly offset portion 36 having an upper mounting hole 38. The lower latch component 28 also includes a front plate 40 extending between the front edges of the end sections 30 and including a central hole 42 surrounded by a rearwardly raised support surface 44 and four threaded holes 46 (only two are shown).

The base 26 also includes a rear portion or restraint cover 48 having a generally cylindrical central portion 50 that is provided with an arcuate slot 52. The restraint cover 48 includes holes 54 corresponding to the threaded holes 46 in the lower latch component 28 and guide means, the purpose for which will be explained hereinafter. In the illustrated arrangement, the guide means includes oppositely disposed channel members 56 extending outwardly from the central portion 50. The channel members 56 define guide channels 58 which are located in registry with the rectangular slots 34 in the lower latch component 28 when the base 26 is assembled.

To attach the restraint cover 48 to the lower latch component 28, screws 60 are inserted through the holes 54 in the restraint cover 48 and are advanced into the threaded holes 46 in the lower latch component 28. The assembled base 26 defines a receptacle 62 for receiving a locking mechanism, as discussed below.

To mount the base 26 on the storage box 10, the inwardly offset portions 36 of the lower latch component 28 are positioned inwardly of the projections 16 on the storage box 10 and the pivot pin 18 is inserted through the projections 16 and through the upper mounting holes 38 in the inwardly offset portions 36. This arrangement supports the base 26 for pivotal movement relative to the storage box 10. While in the illustrated arrangement the base is moveable relative to the storage box 10, in other arrangements the base 26 could be fixed relative to the storage box 10.

Figure 7:
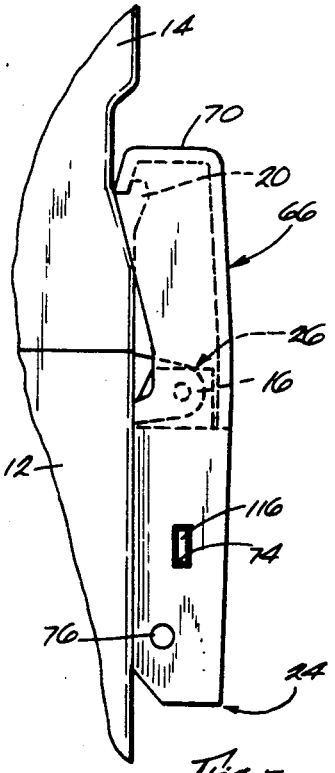
FIG. 7 is an enlarged side elevation view of a portion of the storage box illustrated in FIG. 1.
Figure 8:
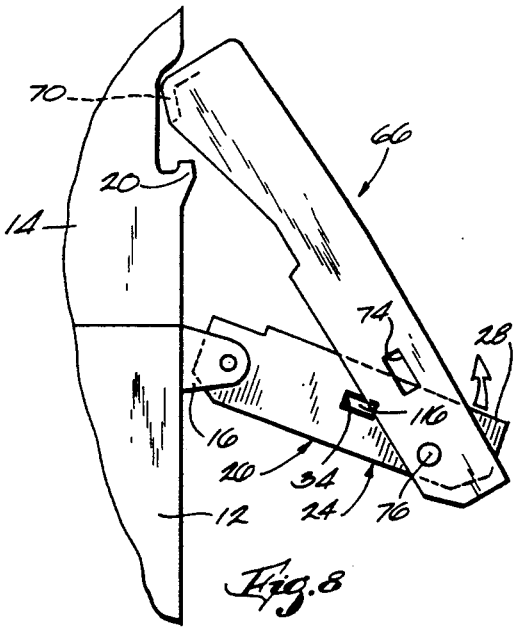
FIG. 8 is a view similar to FIG. 7, but showing the latch assembly in a partially unlatched position.
Figure 9:
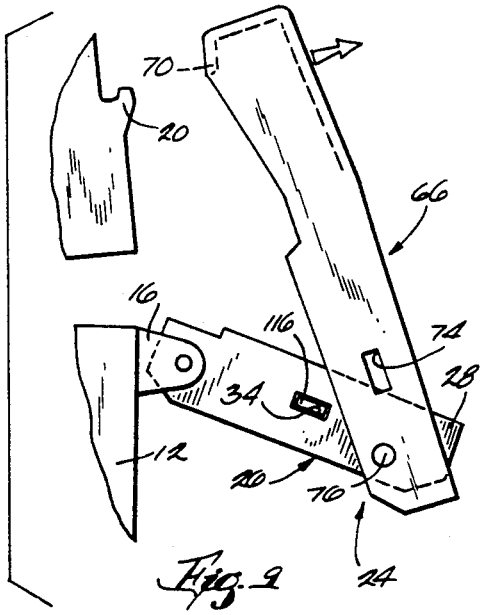
FIG. 9 is a view similar to FIG. 7, but showing the latch assembly in an unlatched position and the cover of the storage box in a partially opened position.

The latch assembly 24 also comprises an upper latch component or latch member 66. The latch member 66 includes upright, opposite side portions 68 and a hook or catch portion 70 extending between the upper ends of the side portions 68. The side portions 68 each have a lower mounting hole 72 and a more centrally positioned rectangular slot 74 that respectively correspond to one of the lower mounting holes 32 and one of the rectangular slots 34 in the lower latch component 28. A pair of pins 76 are press fit into corresponding ones of the lower mounting holes 32 and 72 to support the latch member 66 on the base 26 for pivotal movement relative thereto. As shown in FIGS. 7–9, the latch member 66 is pivotable between a latched position (FIG. 7) wherein each of the rectangular slots 74 in the latch member 66 is in registry with the corresponding rectangular slot 34 in the lower latch component 28, and an unlatched position (FIG. 9).

The latch assembly 24 as thus far described can be unlatched to permit opening of the storage box 10 and can be latched to hold the storage box 10 closed. To unlatch the storage box 10 (see FIGS. 8 and 9), the fingertips are inserted beneath the lower latch component 28 to swing the base 26 upwardly until the catch portion 70 of the latch member 66 is disengaged from the tongue 20 on the storage box 10. Thereafter the storage box 10 can be opened. To latch the storage box 10 closed, the catch portion 70 of the latch member 66 is positioned to capture the tongue 20 and the base 26 is then swung downwardly.

The latch assembly 24 also comprises a locking mechanism 80 for selectively locking the latch member 66 in the latched position. While in the illustrated arrangement the locking mechanism 80 is part of the larger latch assembly 24, it should be understood that in other latch applications the locking mechanism 80 can itself be used as a latch assembly.

Figure 6:
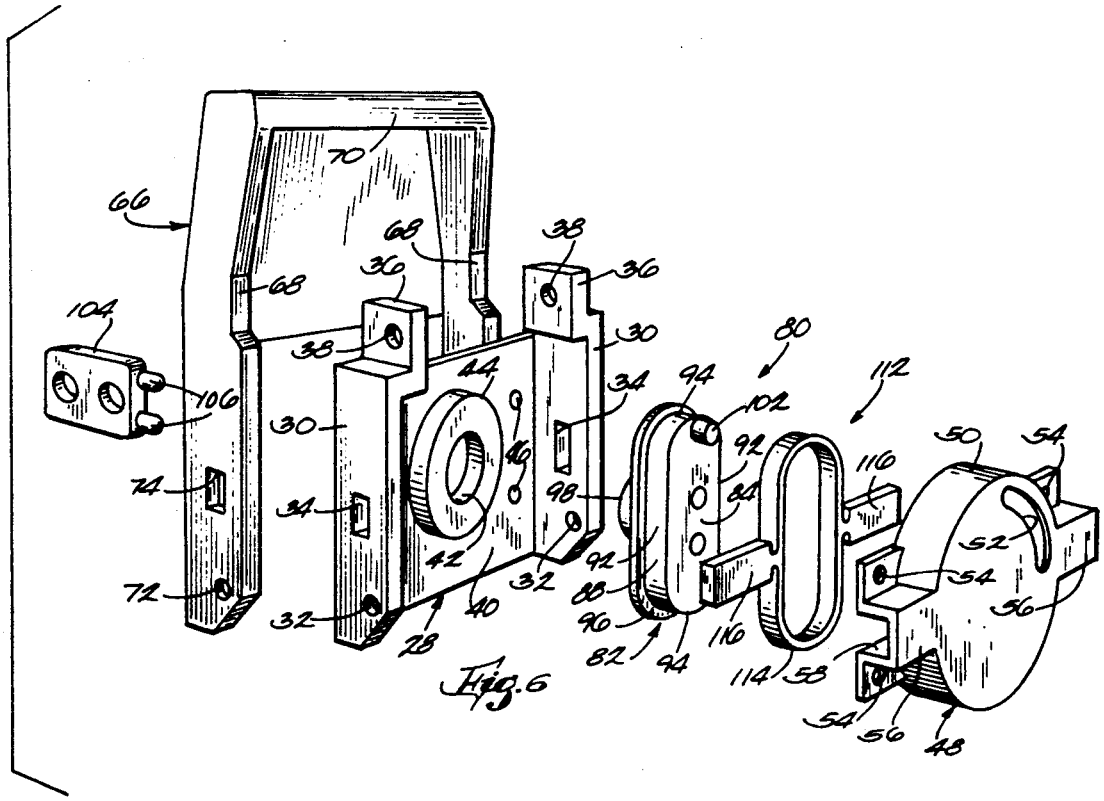
FIG. 6 is an exploded perspective view of the latch assembly in FIGS. 2 through 5.

The locking mechanism 80 includes a driver member 82 housed in the receptacle 62. As shown in FIG. 6, the driver member 82 includes a generally elliptical or oblong body portion 84 having a forwardly facing front surface 86 engageable with the support surface 44 on the lower latch component 28. The elliptically shaped outer surface of the body portion 84 functions as a cam surface 88. The cam surface 88 is elongated in the direction of the longitudinal axis 90 of the body portion 84 and includes elongated opposite side surface portions 92 and shorter opposite end surface portions 94.

The driver member 82 also includes a flange 96 surrounding the body portion 84 and a cylindrical projection 98 extending forwardly from the body portion 84. The cylindrical projection 98 is coaxially received in the central hole 42 in the lower latch component 28 to support the driver member 82 on the base 26 for pivotal movement relative thereto. The pivot axis 100 of the driver member 82 is generally perpendicular to the longitudinal axis 90 of the body portion 84 and is generally parallel to the surface portions 92 and 94 of the cam surface 88. To limit pivotal movement of the driver member, a rearwardly extending guide pin 102 is provided on the body portion 84 and is received in the arcuate slot 52 in the restraint cover 48. The driver member 82 is thereby restricted to a range of pivotal movement of about 90 degrees between a lock position (shown in FIG. 4) and an unlock position (shown in FIGS. 2 and 3).

Figure 2:
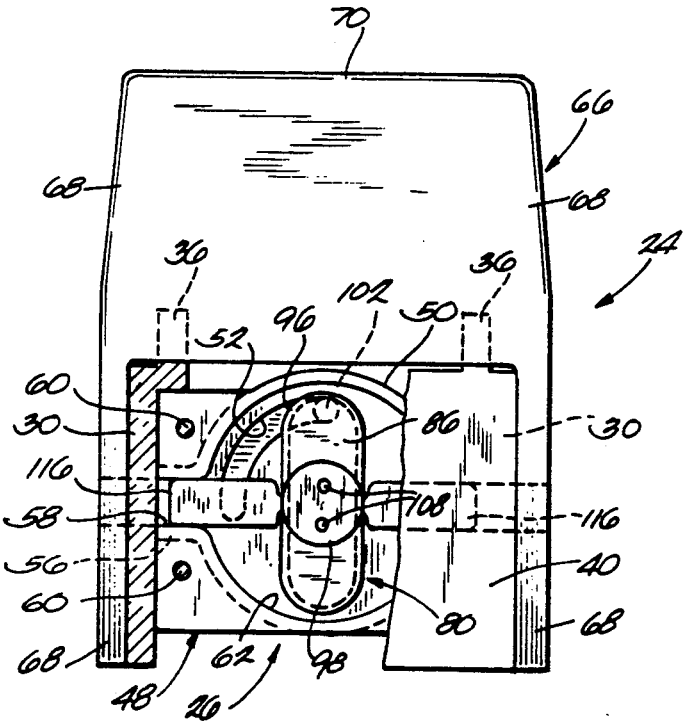
FIG. 2 is an enlarged and fragmentary front elevation view of the latch assembly illustrated in FIG. 1, and partially showing the locking mechanism for the latch assembly, the locking mechanism being shown in an unlock position.
Figure 3:
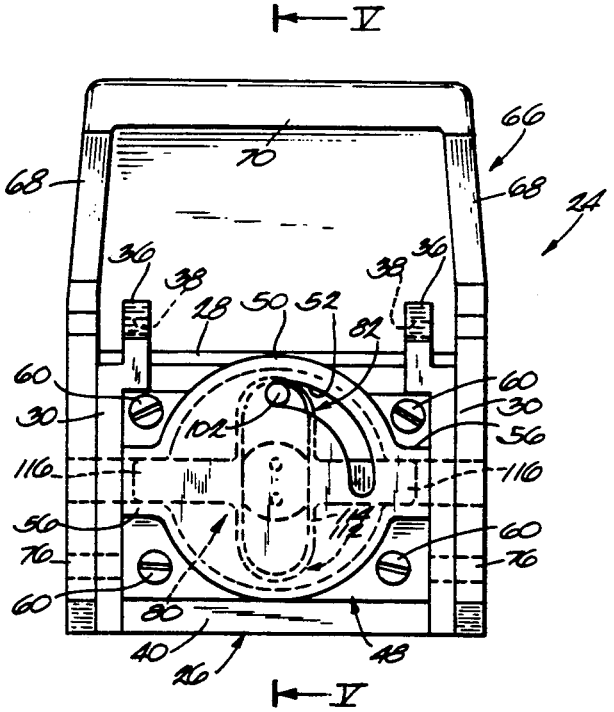
FIG. 3 is a rear elevation view of the latch assembly illustrated in FIG. 2.
Figure 5:
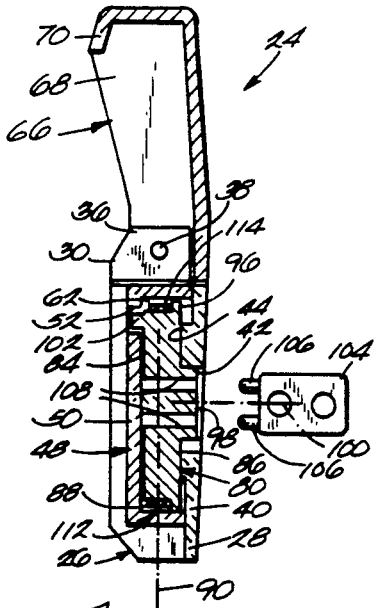
FIG. 5 is a sectional view of the latch assembly taken along line V—V in FIG. 3.
Figure 4:
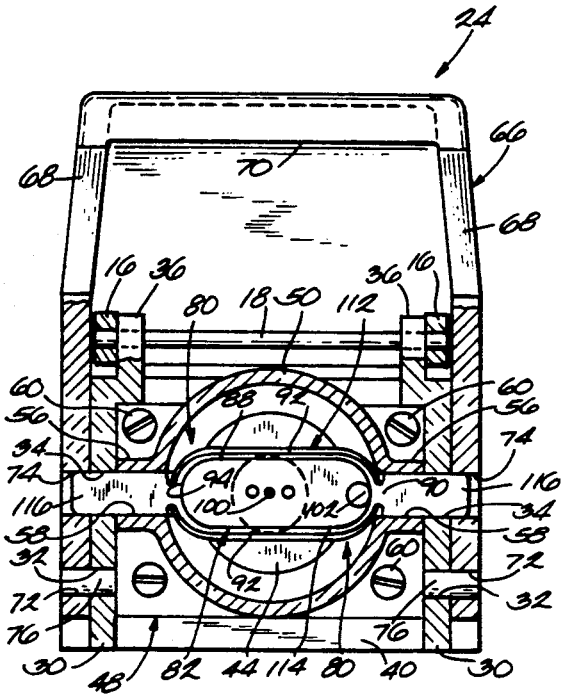
FIG. 4 is a partial cross-sectional view of the latch assembly illustrated in FIG. 3, but showing the locking mechanism in a lock position and showing a portion of the arrangement for mounting the latch assembly on the storage box.

As shown in FIG. 2, the driver member 82 includes key operated lock means to facilitate turning the driver member 82 between the lock and unlock positions. The lock means is adapted for use with a key 104 having spanner elements 106 and includes a pair of spaced key holes 108 in which the spanner elements 106 can be inserted. Thereafter, turning the key 104 pivots the driver member 82.

The main components of the latch assembly 24 thus far described, e.g., the lower latch component 28, the restraint cover 48, the latch member 66 and the driver member 82, are each preferably molded as integral one-piece units from ABS plastic. However, other plastics or metals such as aluminum could also be used.

The locking mechanism 80 also includes a locking member 112 including a flexible ring or band 114 surrounding and slidingly engaging the cam surface 88 of the driver member 82. The band 114 is generally round but is deformable so that when it is placed around the cam surface 88 it conforms to the contour of the cam surface 88 and remains in conformance therewith. The locking member 112 also includes a pair of diametrically opposed locking pins or bars 114 supported in the guide channels 58 and extending radially outwardly from and moveable with opposite portions of the band 114.

To operate the locking mechanism 80, the driver member 82 is operable to deform the band 114 to thereby actuate simultaneous reciprocal movement of the locking bars 116. More specifically, to lock the latch member 66 in the latched position, the driver member 82 can be turned to the lock position to move the locking bars 116 to an extended position (shown in FIG. 4). When in this position, the locking bars 116 extend through the rectangular slots 34 in the lower latch component 28 and into the slots 72 in the latch member 66 to restrict pivotal movement of the latch member 66 relative to the base 26. To unlock the latch assembly 24, the driver member 82 is pivoted to the unlock position to withdraw the locking bars 116 to a retracted position (shown in FIGS. 2 and 3). When in this position the locking bars 116 are disengaged from the latch member 66 and permit manipulation thereof to allow the storage box 10 to be opened.

Advantageously, the latch assembly 24 is provided with a simple, durable and generally maintenance free locking mechanism 80 for releaseably locking the latch assembly 24 in a latched position to prevent the storage box 10 from being opened accidentally or unintentionally. Conveniently, the locking mechanism 80 is sized to fit within the base 26 of the latch assembly 24 while leaving ample room to permit insertion of the fingertips beneath the lower latch component 28 to facilitate easy unlatching of the storage box 10 when desired.

Other features and advantages of the invention are set forth in the following claims.

I claim:

1. A latch assembly comprising:

a base;

a latch member supported on said base for movement relative thereto between a latched position and an unlatched position;

a driver member supported on said base for selective pivotal movement relative thereto between a lock position and an unlock position, said driver member including an elongated annular outer cam surface; and a locking member including a flexible band surrounding said cam surface and slidingly engaging said cam surface, said band being deformable to conform to the contour of said cam surface, and a locking bar moveable with a portion of said band and extending radially outwardly from said portion of said band, said locking bar being reciprocally moveable relative to said base in response to deformation of said band, said locking bar being moveable between a retracted position when said driver member is moved to said unlock position and an extended position when said driver member is moved to said lock position, said locking bar being engageable with said latch member to restrict movement thereof relative to said base when said locking bar is in said extended position.

2. A latch assembly as set forth in claim 1 wherein said driver member is pivotable about a pivot axis extending in a first direction, and wherein said cam surface is elongated in a second direction perpendicular to said first direction.

3. A latch assembly as set forth in claim 1 wherein said driver member is pivotable about a pivot axis, and wherein said cam surface includes elongated opposite side surface portions and opposite end surface portions, each of said surface portions being parallel to said pivot axis.

4. A latch assembly as set forth in claim 1 wherein said locking member includes a pair of diametrically opposed locking bars moveable with opposite portions of said band, each of said locking bars extending radially outwardly from one of said portions of said band, and said locking bars being simultaneously reciprocally movable relative to said base responsive to deformation of said band, each of said locking bars being moveable between a retracted position when said driver member is in said unlock position and an extended position when said driver member is in said lock position, said locking bars being engageable with said latch member to restrict movement thereof relative to said base when said locking bars are in said extended positions.

5. A latch assembly as set forth in claim 1 wherein said cam surface is elliptical.

6. A latch assembly as set forth in claim 1 wherein said base includes guide means for supporting said locking bar for movement between said retracted and extended positions.

7. A latch assembly as set forth in claim 1 wherein said base includes an arcuate slot, and wherein said driver member includes a guide pin received in said slot and for restricting pivotal movement of said driver member to movement between said lock and unlock positions.

8. A latch assembly as set forth in claim 1 wherein said latch member is supported on said base for pivotal movement relative thereto between said latched and unlatched positions.

9. A latch assembly as set forth in claim 1 wherein said locking bar is engageable with said latch member to prevent movement thereof from said latched position to said unlatched position when said locking bar is in said extended position.

10. A latch assembly as set forth in claim 1 wherein said driver member includes key operated lock means for pivoting said driver member.

11. A latch assembly as set forth in claim 10 wherein said lock means includes a pair of key holes adapted for use with a key having spanner elements receivable in said key holes.

12. A latch assembly comprising:

a base;

a latch member supported on said base for movement relative thereto between a latched position and an unlatched position;

a driver member supported on said base for selective pivotal movement relative thereto about a pivot axis and between a lock position and an unlock position, said driver member including a longitudinal axis perpendicular to said pivot axis and an annular outer cam surface, said cam surface being elongated in the direction of said longitudinal axis and said cam surface being parallel to said pivot axis; and a locking member including a flexible band surrounding said cam surface, said band being deformable to conform to the contour of said cam surface, and a locking bar moveable with a portion of said band and extending radially outwardly from said portion of said band, said locking bar being moveable between a retracted position wherein said locking bar is disengaged from said latch member and an extended position wherein said locking bar is engageable with said latch member to prevent movement thereof from said latched position to said unlatched position;

whereby said band is deformable responsive to pivotal movement of said driver member to selectively reciprocate said locking bar between said retracted and extended positions.

13. A latch assembly as set forth in claim 12 wherein said band slidingly engages said cam surface and wherein said driver member is pivotable relative to said locking member.

14. A latch assembly as set forth in claim 12 wherein said locking bar is moved to said retracted position when said driver member is moved to said unlock position and wherein said locking bar is moved to said extended position when said driver member is moved to said lock position.

15. A latch assembly for a storage box including a container portion and a cover portion hingedly mounted on the container portion and moveable between closed and opened positions relative to the container portion, said latch assembly comprising:

a base adapted to be mounted on one of the cover portion and the container portion;

a latch member supported on the base for movement relative thereto between a latched position wherein said latch member is adapted to engage the other of the cover portion and the container portion to secure the cover portion in the closed position and an unlatched position wherein said latch member is disengaged from the other of the cover portion and the container portion so as to permit movement of the cover portion to the opened position; and a locking mechanism for selectively retaining said latch member in said latched position, said locking mechanism including a driver member supported on said base for selective pivotal movement relative thereto between a lock position and an unlock position, said driver member including an elongated annular outer cam surface, and a locking member including a flexible band surrounding said cam surface and slidingly engaging said cam surface, said band being deformable to conform to the contour of said cam surface, and a locking bar moveable with a portion of said band and extending radially outwardly from said portion of said band, said locking bar being reciprocally movable relative to said base between a retracted position when said driver member is moved to said unlock position and an extended position when said driver member is moved to said lock position, said locking bar being engagable with said latch member to restrict movement thereof relative to said base when said locking bar is in said extended position.

16. A latch assembly as set forth in claim 15 wherein said base member is adapted to be pivotally supported on one of the cover portion and the container portion.

17. A latch mechanism for use in securing first and second members against movement relative to one another, said latch mechanism comprising:

a driver member adapted to be supported on the first member for selective pivotal movement relative thereto between a lock position and an unlock position, said driver member including an elongated annular outer cam surface; and a locking member including a flexible band surrounding said cam surface and slidingly engaging said cam surface, said band being deformable to conform to the contour of said cam surface, and a locking bar moveable with a portion of said band and extending radially outwardly from said portion of said band, said locking bar being reciprocally moveable relative to said first member in response to deformation of said band, said locking bar being moveable between a retracted position when said driver member is moved to said unlock position and an extended position when said driver member is moved to said lock position, said locking bar being adapted to engage the second member to restrict movement thereof relative to the first member when said locking bar is in said extended position.

18. A latch mechanism as set forth in claim 17 wherein said driver member is pivotable relative to said locking member about a pivot axis extending in a first direction, and wherein said cam surface is elongated in a second direction perpendicular to said first direction.

19. A latch mechanism as set forth in claim 17 wherein said driver member is pivotable about a pivot axis, and wherein said cam surface includes elongated opposite side surface portions and opposite end surface portions, each of said surface portions being parallel to said pivot axis.

20. A latch mechanism as set forth in claim 17 wherein said locking member includes a pair of diametrically opposed locking bars moveable with opposite portions of said band, each of said locking bars extending radially outwardly from one of said portions of said band, and said locking bars being simultaneously reciprocally movable relative to said base responsive to deformation of said band, each of said locking bars being moveable between a retracted position when said driver member is in said unlock position and an extended position when said driver member is in said lock position, each of said locking bars being adapted to engage the second member to restrict movement thereof relative the first member when said locking bars are in said extended positions.

* * * * *